US005228519A

United States Patent [19]

Coronado et al.

[11] Patent Number: 5,228,519

[45] Date of Patent: Jul. 20, 1993

[54] METHOD AND APPARATUS FOR EXTENDING PRESSURIZATION OF FLUID-ACTUATED WELLBORE TOOLS

[75] Inventors: Martin P. Coronado; Rustom K. Mody, both of Houston, Tex.

[73] Assignee: Baker Hughes Incorporated, Houston, Tex.

[21] Appl. No.: 797,220

[22] Filed: Nov. 25, 1991

[51] Int. Cl.[5] ..... E21B 33/127

[52] U.S. Cl. ..... 166/387; 166/187

[58] Field of Search ..... 166/387, 250, 187, 64

[56] References Cited

U.S. PATENT DOCUMENTS

| | | | |
|---|---|---|---|
| 2,828,823 | 4/1958 | Mounce | 166/187 |
| 3,575,238 | 4/1971 | Shillander | 166/187 |
| 3,690,375 | 9/1972 | Shillander | 166/187 |
| 4,776,396 | 10/1988 | Studholme | 166/187 |
| 4,934,460 | 6/1990 | Coronado | 166/187 X |
| 4,949,793 | 8/1990 | Rubbo et al. | 166/240 X |
| 4,979,567 | 12/1990 | Rubbo | 166/55 X |

*Primary Examiner*—William P. Neuder
*Attorney, Agent, or Firm*—Melvin A. Hunn

[57] ABSTRACT

A method and apparatus is provided for extending a pressurization time interval. The pressurization-extending device includes a number of components which cooperate together. The pressurization-extending device is coupled between a source of pressurized fluid, such as a pump, and a fluid-actuated wellbore tool, such as an inflatable packer or inflatable bridge plug. The components include an input for receiving pressurized fluid from the source of pressurized fluid, and an output for directing pressurized fluid to the fluid-actuated wellbore tool to supply an actuating force to the fluid-actuated wellbore tool. The pressurization-extending device further includes a timer device, which is responsive to the actuating force of the pressurized fluid, for automatically maintaining the actuating force of the pressurized fluid within the fluid-actuated wellbore tool at a preselected force level for a preselected time interval.

27 Claims, 9 Drawing Sheets

T1

T2 = T1 + 1.5 hr.

T3 = T2 + 5 min.

T4 = T3 + 30 sec.

T5 = T4 + 5 sec.

METHOD AND APPARATUS FOR EXTENDING PRESSURIZATION OF FLUID-ACTUATED WELLBORE TOOLS

BACKGROUND OF THE INVENTION

1. Field of the Invention:

The present invention relates to fluid-actuated wellbore tools, and specifically to fluid-actuated wellbore tools which are urged between operating states by a retrievable source of pressurized fluid.

2. Description of the Prior Art:

Fluid-actuated wellbore tools are widely known and used in oil and gas operations, in all phases of drilling, completion, and production. For example, in well completions and work-overs a variety of fluid-actuated packing devices are used, including inflatable packers and bridge plugs. In a work-over operation, a fluid actuated wellbore tool may be lowered into a desired location within the oil and gas well, downward through the internal bore of wellbore tubular strings such as tubing and casing strings.

Recent advances in the technology have allowed fluid-actuated wellbore tools to be lowered into the wellbore through the production tubing on either a wireline assembly or a coiled-tubing workstring. Coiled-tubing workstrings are usually coupled to a pumping unit disposed at the surface, which provides pressure to an actuating fluid which is usually, but not necessarily, a wellbore fluid. The pump at the surface of the wellbore usually has sufficiently high levels of pressure to completely, and reliably, actuate the fluid-actuated wellbore tool.

In contrast, wireline-suspended pumps which are lowered into the wellbore are subject to stringent geometric constraints, particularly when intended for through-tubing operations, and are thus low-power devices, which are rather delicate in comparison with conventional pumps. At peak operating loads which are reached when operating at high pressures, the wireline-suspended pumps are subject to risk of failure, so it is one important objective to minimize the amount of time wireline-suspended pumps are operating at peak loads. However, it is equally important that wellbore tools are fully actuated to prevent expensive and catastrophic mechanical failures in the wellbore, such as can occur when packers and bridge plugs become unset.

Fluid-actuated wellbore tools which include elastomeric components are particularly susceptible to mechanical failure if not fully inflated. For example, fluid-actuated inflatable packing devices, such as inflatable packers and bridge plugs, include substantial elastomeric components, such as annular elastomeric sleeves, which are urged by pressurized wellbore fluids between deflated running positions and inflated setting positions. Of course, in the inflated setting position, the elastomeric components of wellbore packers and bridge plugs are essential in maintaining the wellbore tool in gripping engagement with wellbore surfaces.

Unfortunately, elastomeric sleeves have some mechanical characteristics which can present operating problems. Specifically, elastomeric sleeves require some not-insignificant amount of time to make complete transitions between deflated running positions and inflated setting positions.

It has been discovered that wellbore elastomeric sleeves require several minutes at high inflation pressures to completely conform in shape to the wellbore surface against which it is urged. This process of setting the shape of the elastomeric sleeve is known as "squaring-off" of the elastomeric element. To allow for the beneficial squaring-off of the elastomeric element, a high inflation pressure must be maintained for a brief interval of time once the packer or bridge plug is fully inflated. If the high inflation pressure is not maintained while the packer or bridge plug squares off, squaring off may occur after the inflating pressure is released resulting in a diminished gripping engagement with the casing.

When a wireline-suspended pump is employed, the objective of minimizing peak load operation of the pump is in direct opposition to the objective of maintaining a high setting pressure for a sufficient length of time to allow full and complete actuation and squaring off of the fluid-actuated wellbore tool. This conflict presents a serious operating consideration, which requires considerable judgment which is often only found in very experienced operators.

Prior art systems also include another problem which causes concern. Electric power which is supplied to the wireline-suspended pump is monitored by the operator at the surface of the oil and gas well to determine when the subsurface fluid-actuated wellbore tool is in a desired operating condition. However, the data provided by the electric power monitoring unit is difficult to interpret, and includes a fleeting, but essential, indication of changes in operating conditions of the fluid-actuated wellbore tool, which can be misinterpreted or missed altogether by a distracted, unobservant, or inexperienced operator.

SUMMARY OF THE INVENTION

It is one objective of the present invention to provide an apparatus which automatically and reliably extends the application of an actuating force to a fluid-actuated wellbore tool for a preselected time interval, and which maintains the actuating force at a preselected force level.

It is another objective of the present invention to provide a pressurization extending device for use between a source of pressurized fluid, such as a wireline pump, and a fluid-actuated wellbore tool which includes an elastomeric element, such as an inflatable packer or bridge plug, which is movable between a deflated running position and an inflated setting position, wherein the pressurization-extending device operates to automatically maintain the pressurized fluid at a preselected pressure level for a preselected time interval to ensure full and complete inflation and squaring-off of the fluid-actuated wellbore tool for avoiding slippage due to squaring-off of the elastomeric element after the preselected pressure level is released.

It is yet another objective of the present invention to provide a pressurization-extending device which operates in combination with a source of pressurized fluid, such as a wireline wellbore pump, to actuate a fluid-actuated wellbore tool, and provides the operator with a positive indication that a pressurization-extending mode of operation has occurred, thus improving the reliability of wellbore service operations and eliminating uncertainties associated with actuation of the wellbore tool.

These objectives are achieved as is now described. A pressurization-extending device is provided, and is adapted for coupling between a source of pressurized fluid and a fluid-actuated wellbore tool. The pressurization-extending device includes a number of components which cooperate together. An input means is provided for receiving a pressurized fluid from the source of pressurized fluid. An output means is provided for directing the pressurized fluid to the fluid-actuated wellbore tool to supply an actuating force to the fluid-actuated wellbore tool. A timer means is provided, and is responsive to the actuating force of the pressurized fluid. The timer means automatically maintains the actuating force of the pressurized fluid within the fluid-actuated wellbore tool at a preselected force level for a preselected time interval.

In the preferred embodiment, the timer means includes a fluid cavity which communicates with the input means through a bypass channel, and which is adapted in volume to receive a predetermined amount of fluid over a preselected time interval. Also, in the preferred embodiment, the timer means includes at least one movable piece and at least one stationary piece. The movable piece is advanced relative to the stationary piece by pressurized fluid from an initial position to a final position. Passage of the movable piece from the initial position to the final position defines the preselected time interval of the timer means.

In the preferred embodiment, the pressurization-extending device is especially suited for use with fluid-actuated wellbore tools which include an elastomeric element which is urged between a deflated running position and an inflated setting position, wherein the timer means provides a preselected time interval in which the preselected force is applied to the fluid-actuated wellbore tool, and wherein the preselected time interval is sufficiently long in duration to fully inflate the elastomeric component of the fluid-actuated wellbore tool and to allow squaring-off of the elastomeric element.

In the preferred embodiment, a monitoring means is provided which supplies a signal indicative of the operation of the timer means. Preferably, the monitoring means comprises a visual indicator which provides a signal corresponding to the amplitude and duration of the actuation force of the pressurized fluid within the fluid-actuated wellbore tool.

The present invention may also be characterized as a method of actuating a fluid-actuated wellbore tool, which includes a number of method steps. A source of pressurized fluid and a pressurization-extending device are provided, and coupled together. Pressurized fluid is directed to the fluid-actuated wellbore tool until a preselected pressure threshold is obtained in the pressurized fluid. Operation of the pressurization-extending device is initiated once the preselected pressure threshold is obtained. The pressurization-extending device automatically maintains the pressurized fluid within the fluid-actuated wellbore tool at a preselected pressure level for a preselected time interval. Finally, the operation of the pressurization-extending device is terminated upon expiration of the preselected time interval.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1A:
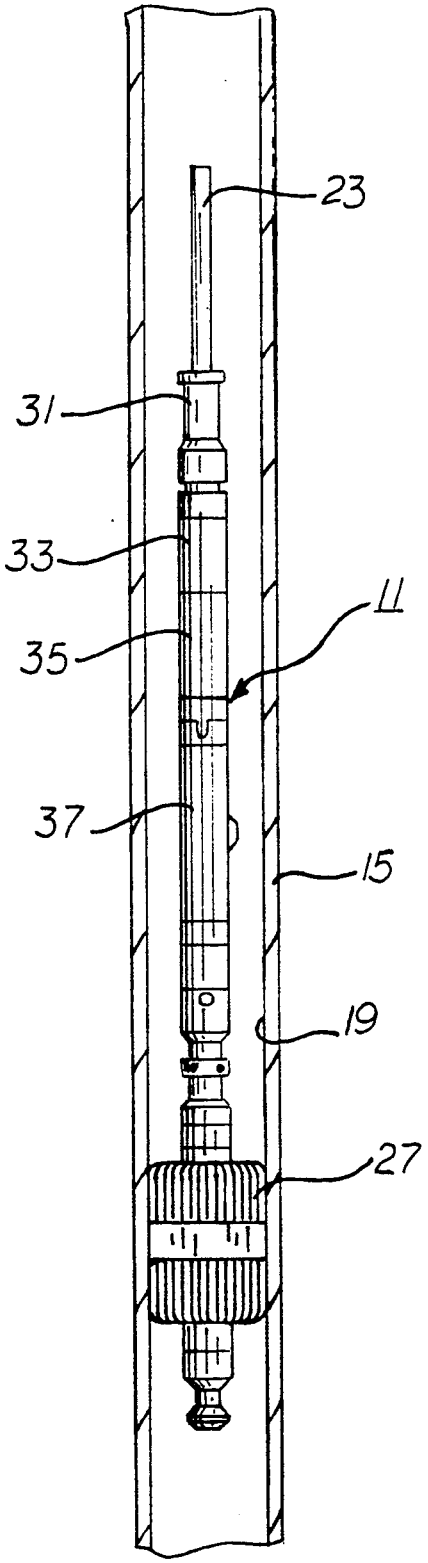
FIGURE 1a PRIOR ART
FIGS. 1*a* and 1*b* are perspective views of prior art wellbore tools, with FIG. 1*a* depicting a tubing-conveyed bridge plug, and with FIG. 1*b* depicting a wireline-conveyed bridge plug.
Figure 1B:
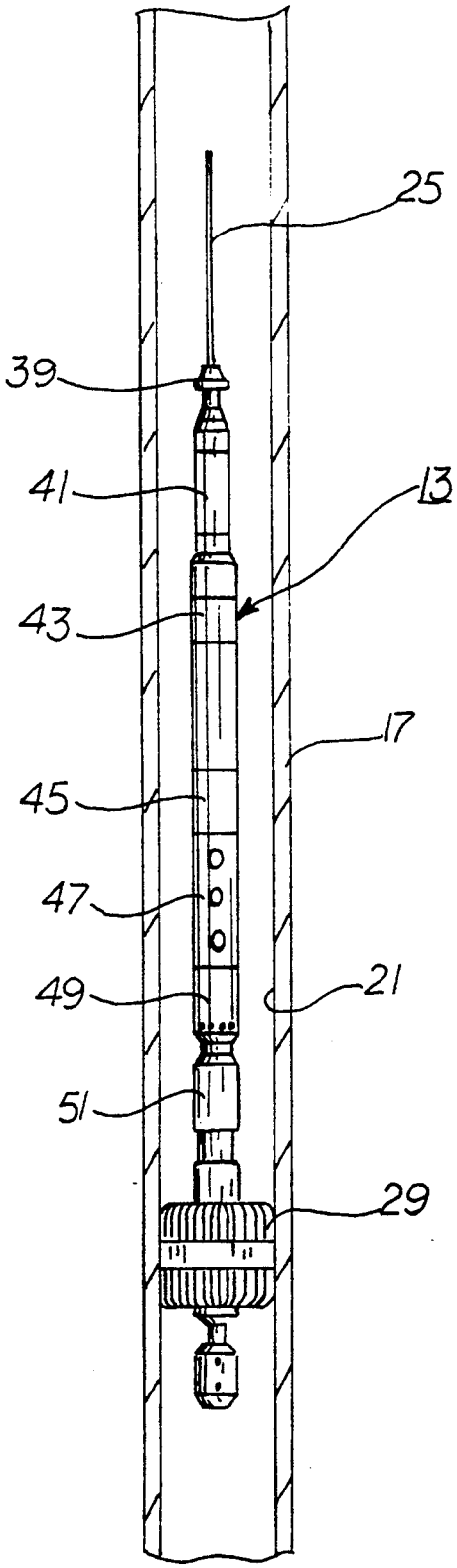
FIGURE 1b PRIOR ART

FIGS. 1*a* and 1*b* are perspective views of prior art wellbore tools 11, 13, depicted concentrically disposed within casing 15, 17, respectively. FIG. 1*a* depicts tubing-conveyed wellbore tool 11 which is raised and lowered within wellbore 19 by coiled tubing string 23. In contrast, in FIG. 1*b*, wireline conveyed wellbore tool 13 is raised and lowered within wellbore 21 by wireline 25.

FIGS. 1*a* and 1*b* depict prior art wellbore tools 11, 13 which include bridge plugs 27, 29, but which could include other fluid-actuated wellbore tools, such as inflatable packers. In FIGS. 1*a*, and 1*b*, bridge plugs 27, 29 are shown in an inflated setting condition with bridge plugs 27, 29 in gripping and sealing engagement with casings 15, 17 respectively.

Coiled-tubing conveyed wellbore tool 11 includes a number of components and subassemblies which are coupled together, and which cooperate to facilitate running and setting of bridge plug 27. Coiled-tubing connector 31 operates to connect wellbore tool 11 to coiled tubing string 23. As is well known in the industry, coiled-tubing string 23 extends upward through wellbore 19, and is coupled at the surface to a conventional pump, which operates to pump pressurized fluid downward through coiled tubing string 23, and into wellbore tool 11.

Back-pressure valve 33 is connected to the lowermost end of coiled-tubing connector 31, and operates to receive pressurized fluid from coiled tubing string 23, but to prevent the backflow of pressurized fluid. Essentially, back-pressure valve 31 operates as a check valve. Hydraulic disconnect 35 is connected to the lowermost end of back-pressure valve 33, and operates to release the portion of wellbore tool 11 which is disposed downwardly from its lowermost end, upon the pressurized fluid within coiled tubing string 23 obtaining a preselected release pressure threshold. If wellbore tool 11 is intended for through-tubing operations, a tubing end locator 37 is coupled between hydraulic disconnect 35 and bridge plug 27, which operates to prevent the setting of bridge plug 27 until wellbore tool 11 is passed entirely through the lowermost portion of the production tubing string (which is not shown in FIG. 1*a*).

Once wellbore tool 11 is disposed in a desired location (preferably in a selected region beneath the production tubing string), pressurized fluid is directed downward from the surface through coiled tubing string 23, and into wellbore tool 11. Back-pressure valve 33 operates to prevent the backwashing of fluid into coiled tubing string 23. Wellbore tool 11 directs pressurized fluid into bridge plug 27 to outwardly radially expand it from a deflated running position to an inflated setting position. Once bridge plug 27 is set, a pressure surge is supplied to the fluid in coiled tubing string 23, which operates hydraulic disconnect 35 to separate wellbore tool 11 into two portions, one of which is retrievable from wellbore 19, and the other which remains within wellbore 19, and is held in a fixed position within wellbore 19 by operation of bridge plug 27.

In contrast, with reference now to FIG. 1*b*, wellbore tool 13 is suspended within wellbore 21 by wireline 25. Wireline 25 is used to raise and lower wellbore tool 15 within wellbore 21. Wellbore tool 13 is secured to wireline 25 by cable head 39. Collar locator 41 is secured to the lowermost end of cable head 39, and operates to provide an indication of the location of the casing collars. Electric motor 43 is coupled to the lowermost end of collar locator 41. One or more motors contained within electric motor 43 are energized by electricity directed downward within wellbore 21 via wireline 25. The electric motors operate to drive a pump located within pump housing 45. The output of pump housing 45 is directed through filter 47 to emergency pull disconnect 49. Emergency pull disconnect 49 operates to release from hydraulic disconnect 51 when a preselected force threshold is obtained by application of upward force which pulls on wireline 25. Emergency pull disconnect 49 is an emergency device which backs up the operation of hydraulic disconnect 51. Hydraulic disconnect 51 is actuated by obtaining a preselected pressure threshold within wellbore tool 13.

In operation, wireline 25 energizes electric motor 43, which actuates a pump disposed within pump housing 45. The pump within pump housing 45 receives wellbore fluid from wellbore 21, and exhausts a high pressure fluid through filter 47, emergency pull disconnect 49, and hydraulic disconnect 51. The fluid is directed into bridge plug 29 to urge it from a deflated running position to an inflated setting position. Once a sufficient pressure level is obtained within bridge plug 29, hydraulic disconnect 51 is actuated to separate bridge plug 29 from the remainder of wellbore tool 13. If hydraulic disconnect 51 fails to operate properly, emergency pull disconnect 49 may be actuated by applying an upward force to wellbore tool 13. If wireline 25 cannot be used to provide sufficient upward force to actuate emergency pull disconnect 49, a workstring such as a coiled tubing string may be lowered to engage wellbore tool 13 and allow for actuation of emergency pull disconnect 49 by applying an upward force thereto.

Figure 2A:
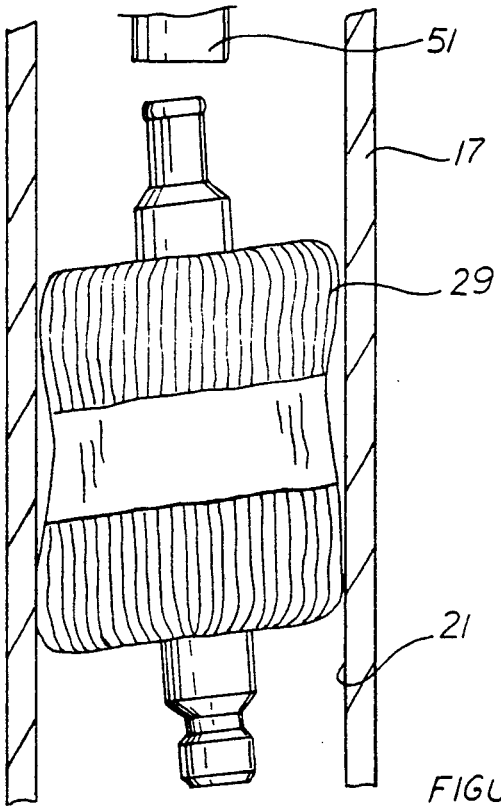
FIGURE 2a PRIOR ART
FIG. 2*a* is a perspective view of the prior art inflatable bridge plug of FIG. 1*b*, in a set position, but not yet "squared-off" relative to the wellbore casing.

FIG. 2*a* is a perspective view of bridge plug 29 of FIG. 1*b* disconnected from hydraulic disconnect 51, and in an inflated condition in gripping engagement with casing 17 of wellbore 21. As is known in the prior art, bridge plug 29 includes an inflation chamber which is defined at least inpart by an inner elastomeric sleeve 55 which is shown in the simplified and fragmentary cross-section view of FIG. 2*d*. Inner elastomeric sleeve 55 is covered and protected on its exterior surface by an array of flexible overlapping slats 57. An outer elastomeric layer 59 is disposed in a central position along the exterior surface of bridge plug 29, and serves to sealingly and grippingly engage casing 17 on wellbore 21 as pressurized fluid 61 fills inflation chamber 53 and urges inner elastomeric sleeve 55, the array of flexible overlapping slats 57, and outer elastomeric layer 59 radially outward.

Figure 2B:
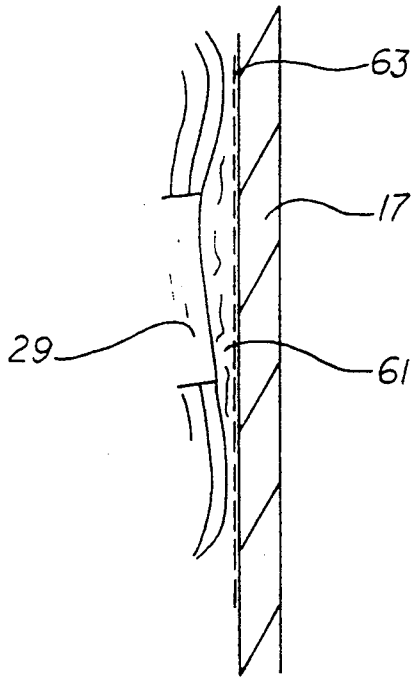
FIGURE 2b PRIOR ART
FIG. 2*b* is a detailed view of the interface of the inflatable bridge plug and wellbore casing of FIG. 1*b*, with a phantom depiction of the bridge plug squared-off against the wellbore casing.

FIG. 2*b* is a detailed view of the interface of inflatable bridge plug 29 and wellbore casing 17 of FIG. 1*b* in a partially-set condition prior to squaring off, with fluid 61 trapped between bridge plug 29 and casing 17. Additionally, bridge plug 29 is depicted in phantom in a squared-off position against wellbore casing 17. Bridge plug 29, like other fluid-actuated wellbore tools which include elastomeric components, is susceptible to mechanical failure due to the mechanical characteristics of the elastomeric components, such as elastomeric sleeves, which comprise such fluid-actuated wellbore tools. Specifically, inner elastomeric sleeve 55, and outer elastomeric layer 59, require some not-insignificant amount of time to make complete transitions between deflated running positions and inflated setting positions. It has been discovered that wellbore elastomeric sleeves, such as those found in bridge plugs, require several minutes at high inflation pressures to completely conform in shape to the wellbore surface against which it is urged. This process of settling of the shape of the elastomeric sleeve is known as "squaring-off" of the elastomeric element.

Figure 2C:
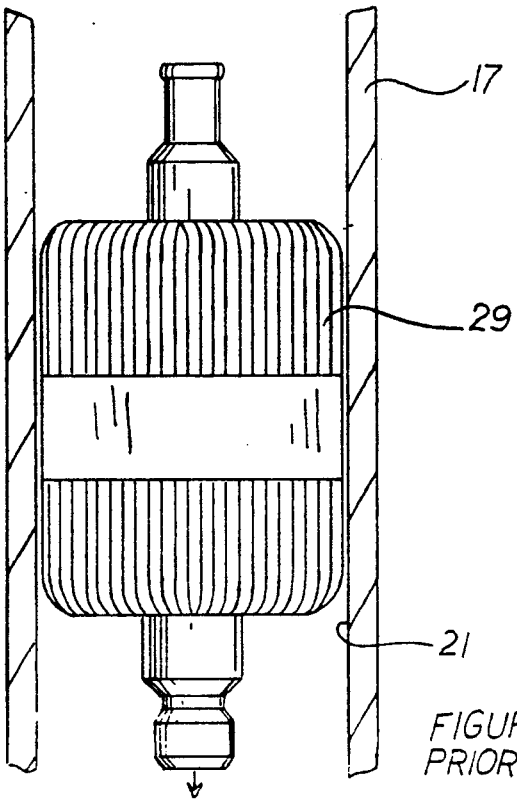
FIGURE 2c PRIOR ART
FIG. 2*c* is a view of the inflatable bridge plug of FIGS. 2*a* and 2*b* depicted sliding downward within the wellbore casing, as a result of inflation pressure being released prior to squaring-off of the inflatable bridge plug relative to the wellbore casing.
Figure 2D:
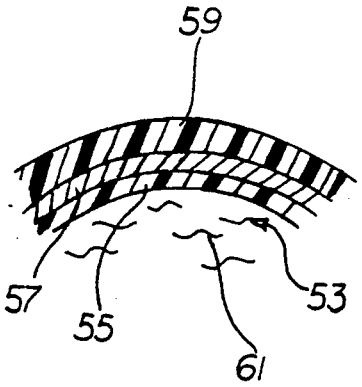
FIGURE 2d PRIOR ART
FIG. 2*d* is a simplified fragmentary cross-section view of the inflatable annular wall of the inflatable bridge plug of FIG. 2*a;*

As shown in FIG. 2*b*, in the inflated condition before squaring-off, fluid 61 is trapped between the annular inflatable wall of bridge plug 29 and casing 17. This occurs because the elastomeric elements in bridge plug 29 inherently resist the change in shape between a deflated running condition and an inflated setting condition. Eventually, however, the elastomeric elements will uniformly inflate to obtain a substantially cylindrical shape 63 (represented by the dashed line in FIG. 2*b*) and maintain substantially uniform contact with casing 17. However, if inflation of bridge plug 29 has ceased, the shifting in shape of bridge plug 29 will result in a fixed amount of fluid within bridge plug 29 attempting to fill a slightly increased volume in the inflation chamber of bridge plug 29. Consequently, the pressure of the fluid trapped within bridge plug 29 will drop. Very tiny changes in the volume of bridge plug 29 due to squaring-off can result in substantial drops in the fluid pressure (in pounds per square inch) which is applied by the fluid to the elastomeric elements of bridge plug 29, and result in a less effective gripping engagement between bridge plug 29 and casing 17. As a consequence, bridge plug 29 may shift or rotate in position within wellbore 21 relative to casing 17. FIG. 2*c* shows bridge plug 29 in a substantially cylindrical shape, after squaring-off. However, the bridge plug no longer maintains good gripping engagement with casing 17, and thus is free to shift downward within wellbore 21.

FIGS. 3*a* through 3*e* depict in simplified form the prior art current sensing devices which are used to monitor inflation of the inflatable packer, in time-sequence order. In prior art devices, conventional current meter devices are used to monitor the current supplied via wireline 25 to electric motor 43. The type of pump employed in pump housing 45 in the prior art is a wobble-plate type pump which receives wellbore fluid and discharges the wellbore fluid at a higher pressure. Due to the severe geometric constraints imposed upon through-tubing work over equipment, the pump disposed in pump housing 45 delivers very small quantities of fluid to bridge plug 29. Therefore, it frequently takes between one hour to one and one-half hours to completely fill bridge plug 29, in an ordinary case. In the preferred embodiment, the prior art wireline-suspended pump is manufactured by Baker Service Tools, a division of Baker Hughes Incorporated of Houston, Tex. This pump has an output of approximately 0.17 milliliters per minute. In the preferred embodiment, bridge plug 29 is also manufactured by Baker Service Tools, a division of Baker Hughes Incorporated. Typically, bridge plug 29 will set, that is, engage casing 17, at about 50 pounds per square inch of pressure. Also, typically, hydraulic disconnect 51 of FIG. 1*b* will disconnect at 1,500 pounds per square inch of pressure.

In the prior art, amp meter 65 is monitored to determine the current delivered to electric motor 43, from which the internal pressure of bridge plug 29 can be inferred. Amp meter 65 includes amperage indicator 67, and graduated dial 69. Usually, the dial indicates the RMS current flow delivered to electric motor 43 through wireline 25. As shown, graduated dial 69 is provided to indicate total amps of current delivered. For purposes of simplicity and exposition, graduated dial 69 is shown only to depict the range of 0 through 0.8 amps of current. Also, the following amperage readings and time intervals discussed are illustrative only since they indicate relative readings and not exact values that will be encountered under varied conditions in the field.

Figure 3A:
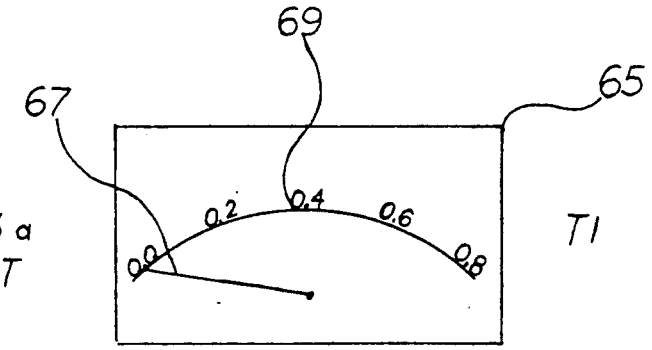
FIGURE 3 a PRIOR ART
FIGS. 3*a*, 3*b*, 3*c*, 3*d* and 3*e* are depictions of a prior art current sensing device which is used to monitor inflation of fluid-actuated wellbore tools, in time-sequence order.
Figure 3B:
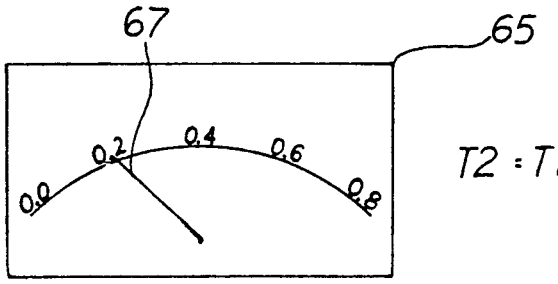
FIGURE 3 b PRIOR ART

FIG. 3*a* shows the amperage indicator at time T1, immediately prior to the pump within pump housing 45 being started. As shown in FIG. 3*b*, after time T1 the pump within pump housing 45 is driven by electric motor 43 to deliver fluid to bridge plug 29. For substantial amounts of time, approximately 200 milliamperes (that is, 0.20 amps) are delivered via wireline 25.

Amperage indicator 67 remains in the range of 0.20 amps for approximately one hour to one and one-half hours, as shown in FIG. 3*b* at time T2. However, in a very short interval of time after T2, shown as approximately one minute in FIGS. 3*c* and 3*d*, amperage indicator 67 will rise quickly to approximately 800 milliamps. This indicates to the observant operator that bridge plug 29 is fully inflated. During this short time interval shown in FIGS. 3*c* and 3*d* as one minute, the pressure within bridge plug 29 will rise rapidly up to 1,500 pounds per square inch of pressure. At 1,500 pounds per square inch of pressure, hydraulic disconnect 51 operates to release bridge plug 29. As a consequence, the pump disposed within pump housing 45 no longer delivers fluid to bridge plug 29, but continues pumping nonetheless, circulating well fluid 61 back into wellbore 21.

Preferably, to prolong the motor life, electric power to the pumping unit should be discontinued, and the pump should be raised to the surface of the wellbore. FIG. 3*e* depicts amp meter 65 at time T5 after actuation of hydraulic disconnect 51. As shown, amperage indicator 67 returns to a reading of approximately 0.2 amperes of current. If the operator is distracted, it is easy to miss the short time interval of elevated amperage readings depicted in FIGS. 3*c* and 3*d*.

Figure 3C:
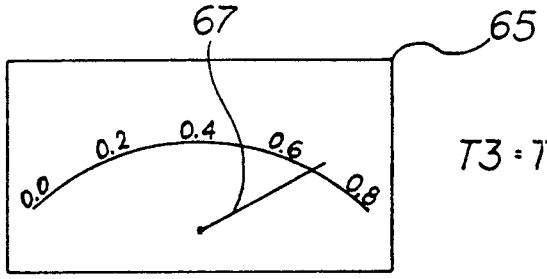
FIGURE 3 c PRIOR ART
Figure 3D:
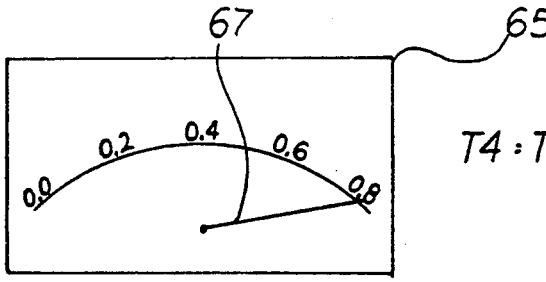
FIGURE 3 d PRIOR ART
Figure 3E:
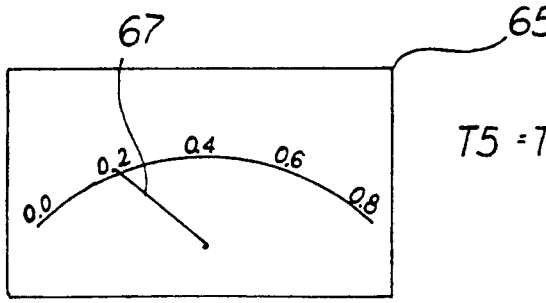
FIGURE 3 e PRIOR ART

The high amperage readings of FIGS. 3*c* and 3*d* are the sole indication to the operator that bridge plug 29 is indeed fully inflated, and that hydraulic disconnect 51 is actuated to disconnect bridge plug 29 from the remainder of wellbore tool 13. If this indication of pressurization of bridge plug 29 is missed, the operator may remain at the location for substantial periods of time, with the pump operating for no useful purpose, shortening the life of the expensive pump. This can result in embarrassment to the operator, and a waste of valuable operating time.

Figure 4:
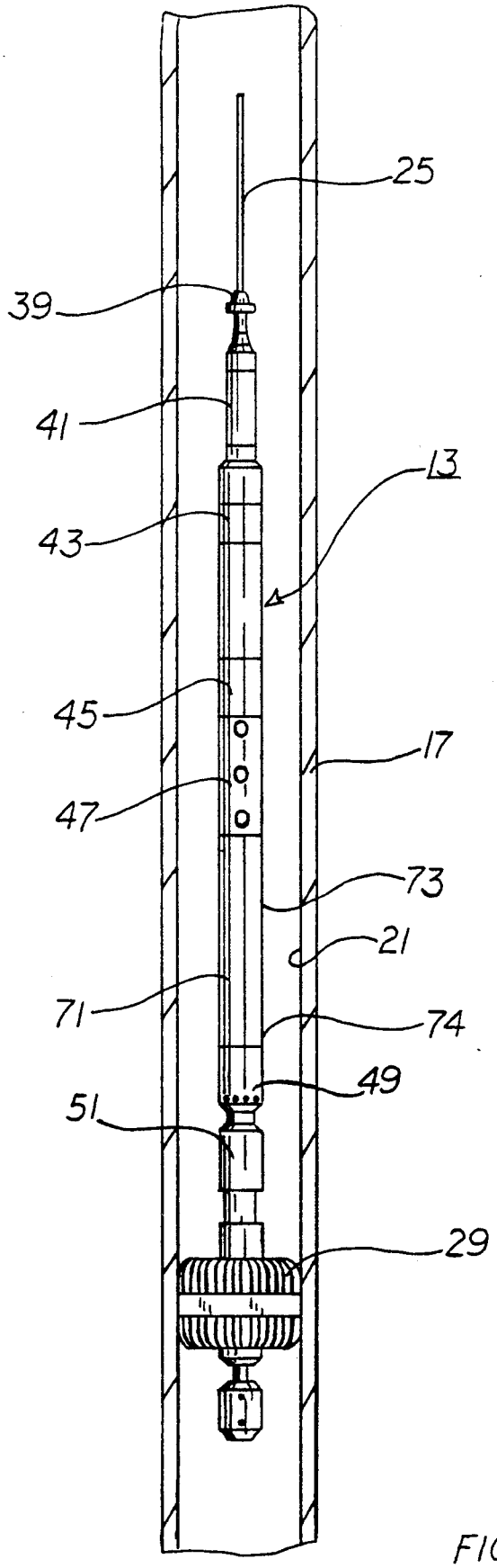
FIG. 4 is a perspective view of a wireline-conveyed wellbore packing device coupled to a source of pressurized fluid through the preferred pressurization-extending apparatus of the present invention.
Figure 5:
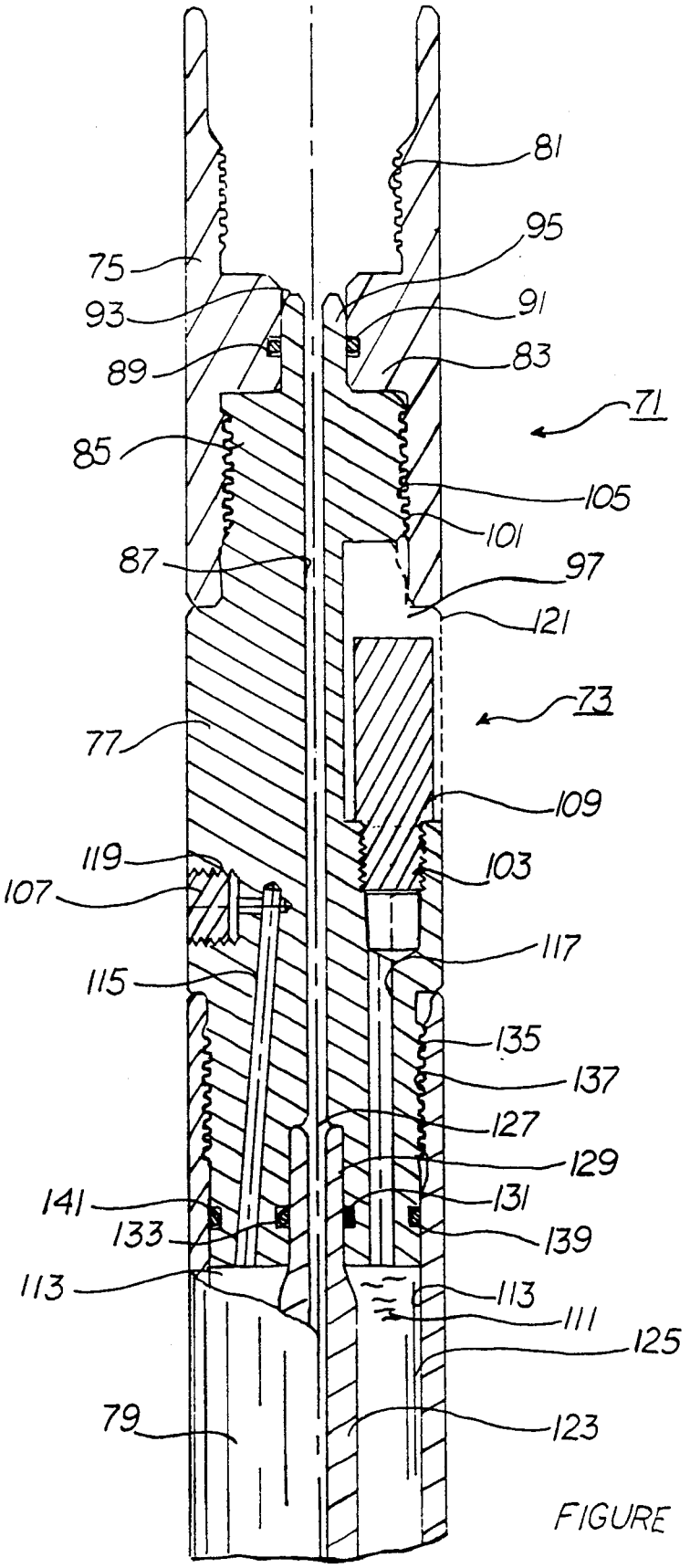
FIG. 5 is a fragmentary longitudinal section view of an upper region of the preferred pressurization-extending apparatus of the present invention, in an initial operating condition.
Figure 6:
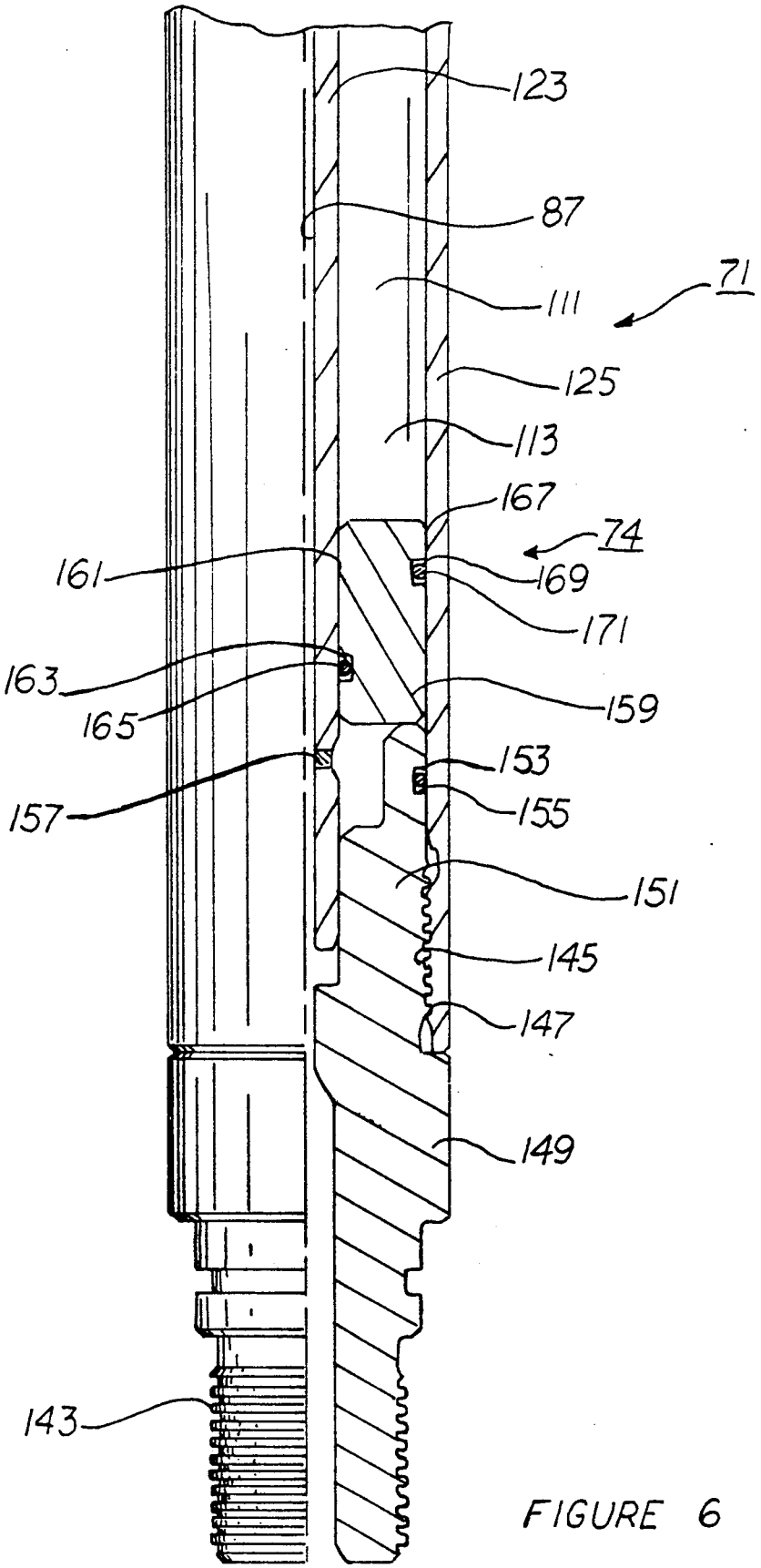
FIG. 6 is a one-quarter longitudinal section view of a lower region of the preferred pressurization-extending apparatus of the present invention, in an initial operating condition.
Figure 7:
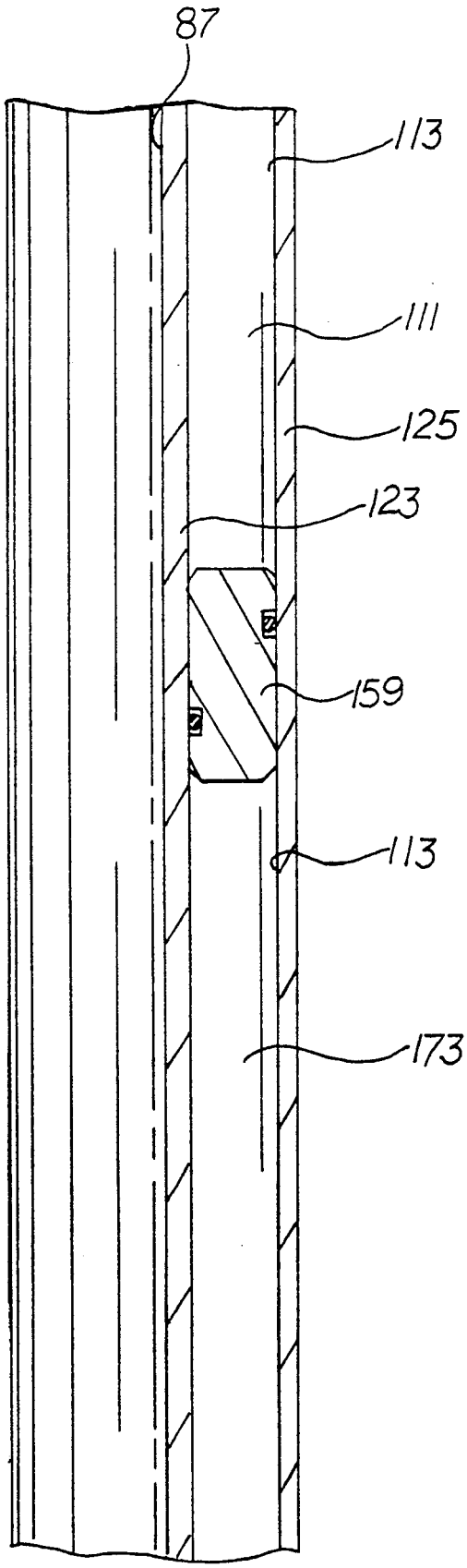
FIG. 7 is a one-quarter longitudinal section view of a middle-region of the preferred pressurization-extending device of the present invention, in an intermediate operating condition.
Figure 8:
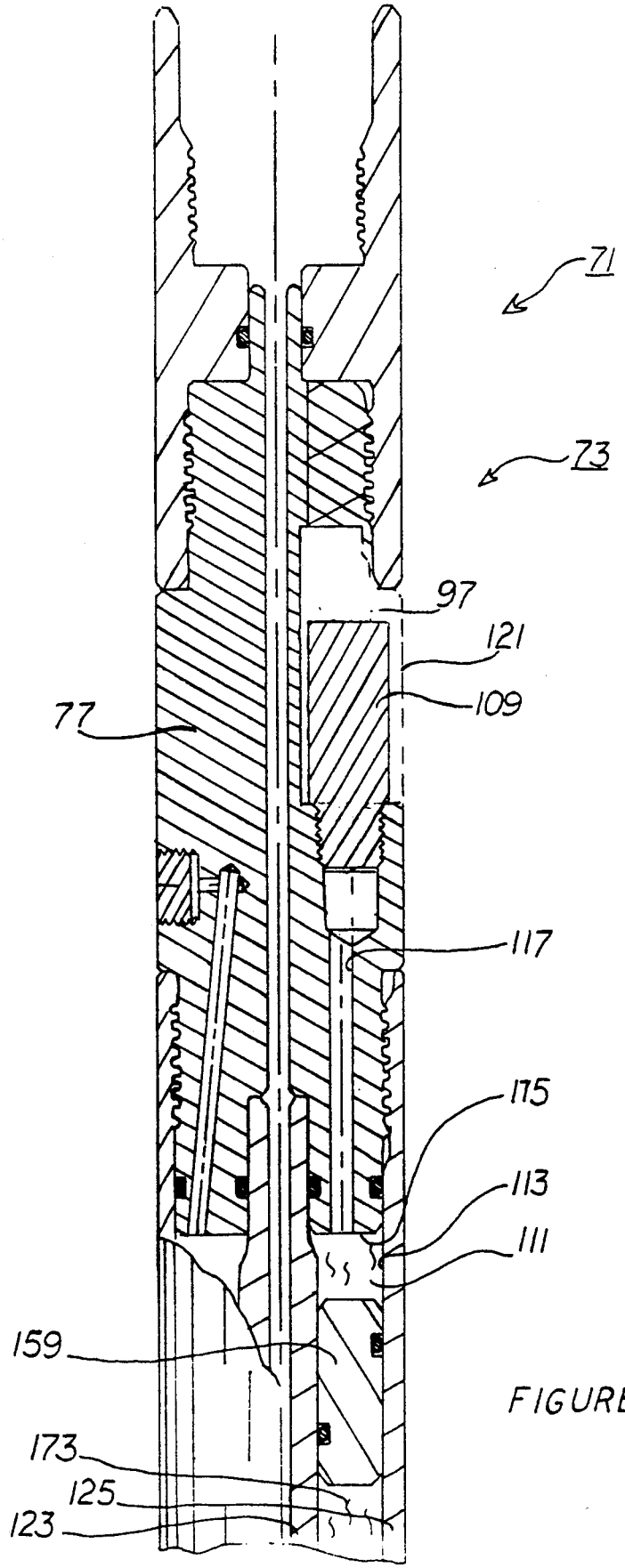
FIG. 8 is a fragmentary longitudinal section view of an upper region of the preferred pressurization-extending device of the present invention, in an intermediate operation condition.

The present invention presents solutions to these problems encountered in the prior art devices. The preferred embodiment of the present invention is depicted in FIGS. 4, 5, 6, 7, and 8. FIG. 4 is a perspective view of the preferred pressurization-extending device 71 of the present invention coupled between filter 47 and emergency pull disconnect 49 of the wellbore tool 13. FIG. 5 is a fragmentary longitudinal section view of upper region 73 of the preferred pressurization-extending apparatus 71 of the present invention in an initial operating condition. FIG. 6 is a one-quarter full longitudinal section of lower region of the preferred pressurization-extending apparatus 71 of the present invention, in an initial operating condition. FIG. 7 is a one-quarter longitudinal section view of the middle region of the preferred pressurization-extending device 71 of the present invention, in an intermediate operating condition. FIG. 8 is a full longitudinal section view of upper region 73 of the preferred pressurization-extending device 71 of the present invention, in an intermediate operating condition.

As shown in FIG. 4, pressurization-extending device 71 is coupled into wellbore tool 13 of FIG. 1*b*, between filter 47 and emergency pull disconnect 49.

FIG. 5 is a fragmentary longitudinal section view of upper region 73 of the preferred pressurization-extending device 71 of the present invention. At upper region 73, pressurization-extending device 71 includes connector member 75, valve member 77, and central housing 79 which are mated together. Connector member 75 serves to couple pressurization-extending device 71 to filter 47, and includes internal threads 81 for mating with external threads carried by filter 47. Connector member 75 also includes shoulder 83, which is annular in shape, and which includes O-ring seal cavity 89 which carries O-ring seal 91. A central bore 93 is defined by shoulder 83, and is adapted to receive male end piece 95 of valve member 77. O-ring seal 91 mates against the exterior surface of male end piece 95. Shoulder 83 serves to abut shoulder 85 which is also carried by valve member 77. Central bore 87 is provided in valve member 77, and is adapted to receive fluid from filter 47 and direct it downward within pressurization-extending device 71.

The exterior surface of the upper portion of valve member 77 has external threads which threadingly engage internal threads 105 of connector member 75. The central region of valve member 77 has a horizontal slot 97 milled into the side of valve member 77, the exterior of slot 97 being depicted by phantom line 121. A pressure actuated relief valve 109 is carried in the horizontal slot 97 of valve member 77, and threadingly engages valve member 77 at threads 103. Valve member 77 also has a fill port 119 that is sealed by a fill port plug 107. The fill port plug 107 is exteriorly threaded, and engages internal threads in port 119.

At the surface of the well, threaded plug 107 is removed from fill port 119 to fill annular cavity 113 with a "clean" filler fluid 111, such as a light oil or kerosine. The filler fluid 111 passes from the fill port 119 through feed line 115 to the annular cavity 113.

Pressure-actuated release valve 109 communicates with annular cavity 113 through discharge line 117. In the preferred embodiment, pressure-actuated release valve 109 is comprised of a miniature pressure relief valve manufactured by Pneu-Hydro which is further identified by Model No. 404M4Q, and is available from Hatfield Company at 11922 Cutten Road in Houston, Tex. Pressure-actuated release valve 109 operates to vent fluid 111 from annular cavity 113 when a preselected pressure threshold is obtained within annular cavity 113. The pressure relief valve 109 vents the fluid 111 to the exterior of the tool through ports which are not depicted in the figures.

Central housing 79 includes inner annular member 123 concentrically disposed within outer annular member 125, defining annular cavity 113 therebetween. Enlarged region 127 of central bore 87 of valve member 77 operates to receive male end piece 129 of inner annular member 123, and includes O-ring seal cavity 131 with O-ring seal 133 disposed therein for mating against male end piece 129.

Outer annular member 125 is equipped with internal threads 135, which engage external threads 137 of the lower end of valve member 77. O-ring cavity 139 is provided on the exterior surface of valve member 77 for receipt of O-ring seal 141 which seals against the interior surface of outer annular member 125.

FIG. 6 is a one-quarter longitudinal section view of lower region 74 of pressurization-extending device 71 of the present invention. As shown, lowermost end of pressurization-extending device 71 includes a collar member 149 which has external threads 143 for mating with emergency pull disconnect 49 of FIG. 4. The lowermost end of pressurization-extending device 71 is also equipped with external threads 145 on collar member 149 which mate with internal threads 147 of outer annular member 125. Collar member 149 includes shoulder 151 which is disposed between inner annular member 123 and outer annular member 125. O-ring seal cavity 153 is provided in the exterior surface of collar member 149, for receiving O-ring seal 155, which seals against the interior surface of outer annular member 125.

Port 157 is provided through inner annular member 123, and allows the communication of fluid from central bore 87 into annular cavity 113. Annular plug 159 is provided in the space between inner annular member 123 and outer annular member 125. Inner surface 161 of annular plug 159 is adapted for interfacing with inner annular member 123, and is equipped with O-ring seal cavity 163, which carries O-ring seal 165, which is adapted for sealingly engaging inner annular member 123. Annular plug 159 is also provided with outer surface 167, which includes O-ring seal cavity 169, which receives O-ring seal 171, which serves to sealingly engage outer annular member 125.

Annular plug 159 operates as a "piston", while inner annular member 123 and outer annular member 125 cooperate to define an annular region which operates as a "cylinder" for receipt of annular plug 159. In operation, annular plug 159 may be driven from lower region 74 to upper region 73 of pressurization-extending device 71 when a preselected pressure differential is developed between the fluid carried within central bore 87 and the filler fluid 111, which is disposed upward from annular plug 159. Of course, filler fluid 111 is considered as incompressible; therefore, in order for annular plug 159 to be moved upward within annular cavity 113, pressure-actuated release valve 109 must be actuated to vent fluid from annular cavity 113 to wellbore 21. In the preferred embodiment, pressure-actuated release valve 109 is selected to vent fluid to the exterior of pressurization-extending device 71 when pressure within central bore 87 exceeds 1,000 pounds per square inch. Of course, the force of the fluid carried within central bore 87 is transferred to pressure-actuated release valve 109 through annular plug 159 and filler fluid 111.

Upon obtaining the preselected pressure level in central bore 87, pressure-actuated release valve 109 is moved from a normally-closed position to an open position to vent fluid to the exterior of pressurization-extending device 71, and annular plug 159 is urged to travel from lower region 74 to upper region 73 through annular cavity 113. As annular plug 159 is moved upward, wellbore fluid 173 from the pump in housing 45 enters annular cavity 113.

FIG. 7 is a one-quarter longitudinal section view of a middle region of the preferred pressurization-extending device 71 of the present invention, in an intermediate operating condition, with wellbore fluid disposed beneath annular plug 159, and filler fluid 111 disposed above annular plug 159. Once pressure-actuated release valve 109 is moved from the normally-closed position to the open position, the pressure differential between the wellbore fluid 173 and the filler fluid 111 will drive annular plug 159 upward toward upper region 73 of pressurization-extending device 71.

In the preferred embodiment, the pressurization-extending device 71 of the present invention can be adapted to provide a preselected and known time interval from the start of travel of annular plug 159 to the finish of travel of annular plug 159. The duration of the travel of annular plug 159 is determined by the volume of annular cavity 113, the surface area of annular plug 159 which is exposed to the pressure differential, the capacity of the pump employed, the amount of frictional engagement between annular plug 159 and inner and outer annular members 123, 125, the weight of annular plug 159, and the length of inner and outer annular members 123, 125.

In the preferred embodiment, inner annular member 123 has an outer diameter of ⅝ inches, and outer annular member 125 has an inner diameter of 1 ¾ inches. In the preferred embodiment, inner surface 161, and outer surface 167 of annular plug 159 are 1 ½ inches long. Annular plug 159 has a width which is sufficient to substantially occlude annular cavity 113. The frictional engagement between annular plug 159 and inner and outer annular members 123, 125 is minimal. As stated above, the pump capacity of the pump disposed in pump housing 45 is approximately 0.17 milliliters per minute. In the preferred embodiment, the distance traversed by annular plug 159 is four feet. These values taken together establish a travel time of annular plug 59 of approximately five minutes. Of course, using different geometries, and pumps, longer or shorter timer durations may be obtained.

FIG. 8 is a fragmentary longitudinal section view of upper region 73 of the preferred pressurization-extending device 71 of the present invention. As shown, annular plug 159 has operated to discharge substantially all filler fluid 111 from annular cavity 113 through pressure-actuated release valve 109. Annular plug 159 will continue its travel until it abuts lower end 175 of valve member 77. Annular plug 159 serves to prevent wellbore fluid 173 from exiting through pressure-actuating release valve 109.

When viewed broadly, pressurization-extending device 71 of the present invention is adapted for coupling between a source of pressurized fluid, such as the pump disposed within pump housing 45, and a fluid-actuated wellbore tool, such as bridge plug 29. The pressurization-extending device 71 includes an input means for receiving pressurized fluid from the source of pressurized fluid. It also includes an output means for directing pressurized fluid to the fluid-actuated wellbore tool to supply an actuating force to the fluid-actuated wellbore tool. The preferred pressurization-extending device of the present invention also includes a timer means, which is responsive to the actuating force of the pressurized fluid, for automatically maintaining the actuation force of the pressurized fluid within the fluid-actuated wellbore tool at a preselected force level for preselected time interval.

In the preferred embodiment, once 1,000 pounds per square inch of pressure is obtained within central bore 87 of pressurization-extending device 71, pressure-actuated release valve 109 moves between a normally-closed position and an open position. This allows filler fluid 111 to be discharged through pressure-actuated release valve 109, and further allows annular plug 159 to move from lower region 74 to upper region 73 within annular cavity 113. As annular plug 159 travels within annular cavity 113, the level of pressure provided to bridge plug 29 remains constant.

The five minute time interval provided by the travel of annular plug 159 has been determined, through experimentation, to be a sufficient amount of time for the elastomeric elements contained in bridge plug 29 to fully inflate. In other words, the five minute time interval has been determined to be a time interval sufficient in length to allow for "squaring-off" of the elastomeric elements of bridge plug 29. When other inflatable wellbore tools are used, different time intervals may be needed to completely and fully move inflatable elements between deflated running positions and inflated setting positions.

Once annular plug 159 has traveled the full distance within annular cavity 113, pressure within central bore 87, and consequently within bridge plug 29, begins to build again from 1,000 pounds per square inch to approximately 1,500 pounds per square inch. Upon obtaining 1,500 pounds per square inch of pressure within wellbore tool 13, hydraulic disconnect 51 is actuated to separate bridge plug 29 from the remainder of wellbore tool 13 (of FIG. 4). Therefore, it is clear that the timer means which is provided by the preferred pressurization-extending device 71 of the present invention is sensitive to the actuating force of the pressurized fluid which is provided to the fluid-actuated wellbore tools, such as bridge plug 29. Until pressure-actuated release valve 109 is moved between normally-closed and open positions, filler fluid 111 within annular cavity 113 operates to bias annular plug 159 to an initial position at lower region 74 of pressurization-extending device 71.

The time means provided in the preferred embodiment of pressurization-extending device 71 is operable in a plurality of operating modes, including: an initial operating mode, a start-up operation mode, a timing operating mode, and a termination operation mode. During the initial operation mode, annular plug 159 is urged into its initial position at lower region 74 of pressurization-extending device 71 by the biasing means, which preferably comprises filler fluid 111 in annular cavity 113, which is substantially incompressible and held in position by pressure-actuated release valve 109. During a start-up operating mode, the means for biasing is at least in-part overridden. Preferably, pressure-actuated release valve 109 does not allow filler fluid 111 to "gush" from annular cavity 113. Rather, the venting ports are similar in size to port 157.

In a timing mode of operation, annular plug 159 is moved between lower region 74 and upper region 73, and thus between opposite ends of annular cavity 113, in the duration of a preselected time interval, while at least a portion of the pressurized fluid within central bore 87 is diverted into annular cavity 113. During a termination mode of operation, annular plug 159 is disposed at the upper region 73 of pressurization-extending device 71, and pressurized fluid is no longer diverted into annular cavity 113, and is instead directed to the fluid-actuated wellbore tool, such as bridge plug 29.

Figure 9A:
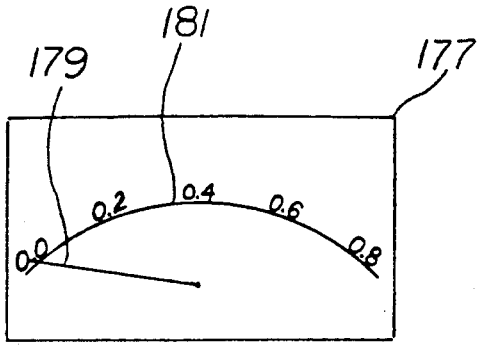
FIGS. 9*a*, 9*b*, 9*c*, 9*d* and 9*e* are depictions of a prior art current sensing device which is used to monitor inflation of fluid-actuated wellbore tools, in time-sequence order, which illustrate one advantage of the use of the pressurization-extending device of the present invention.
Figure 9B:
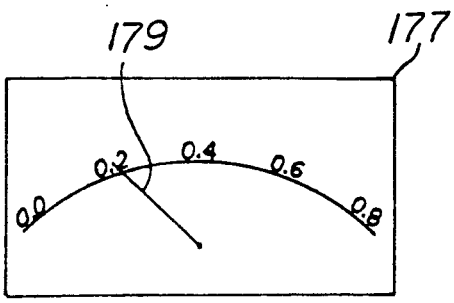

The preferred pressurization-extending device 71 of the present invention is also advantageous over the prior art in that it provides a visual indication of the operation of the "timing" function of the present invention. FIGS. 9*a*, 9*b*, 9*c*, 9*d*, and 9*e* are simplified depictions of the prior art current sensing device which is used to monitor inflation of a fluid-actuated wellbore tool, in time-sequence order, which illustrate one advantage in using the pressurization-extending device 71 of the present invention. The following amperage values and time increments are discussed for illustrative purposes only, and do not represent exact values that would be seen in the field under varied conditions. As shown, amp meter 177 includes amperage indicator 179 and graduated dial 181. Prior to initiating operation of pressurization-extending device 71, no current is indicated on amperage indicator 179 as is shown in FIG. 9*a* immediately prior to time T1. As shown in FIG. 9*b*, from time T1 until time T2, amperage indicator 179 reveals that the total current delivered to electric motor 43 is in the range of 0.20 amperes. As in the prior art, it requires approximately one hour to one and one-half hours to fill bridge plug 29.

Figure 9C:
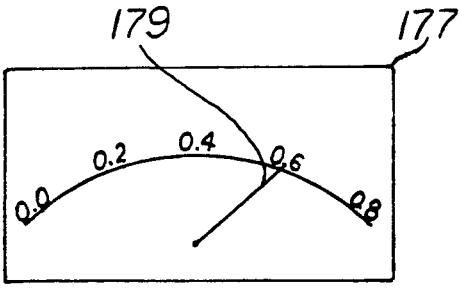
Figure 9D:
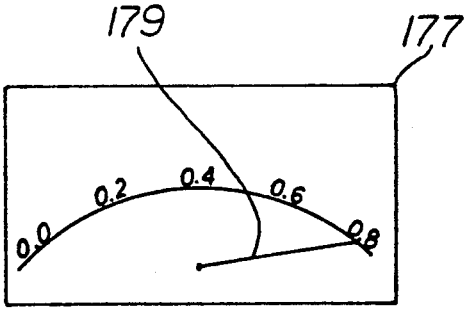
Figure 9E:
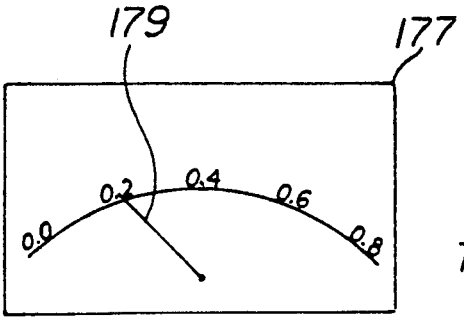

As shown in FIG. 9*c*, at time T3, time T2 plus five minutes, amperage indicator 179 has increased to indicate that electric motor 43 is drawing 0.60 amperes of current. This indicates to the operator that approximately 1,000 pounds per square inch of pressure has been obtained within bridge plug 29. As stated above, this pressure level is sufficient to actuate pressure-actuated release valve 109, and allow filler fluid 111 to exit from annular cavity 113. The pressure within bridge plug 29 will be maintained at approximately 1,000 pounds per square inch for the duration of travel of annular plug 159, which is about five minutes. Therefore, as shown in FIG. 9*c*, the current supplied to electric motor 43 is maintained at 0.6 amps for approximately five minutes. This five minute interval of constant pressure within bridge plug 29 serves to fully inflate bridge plug 29 and allow "squaring-off" of the elastomeric elements therein. This five minute interval also alerts the operator to the fact that the pressurization-extending device 71 of the present invention has been actuated. The five minute interval provides a significantly longer indication of full inflation of bridge plug 29, and thus minimizes the chance of the operator failing to detect full pressurization of bridge plug 29. As shown in FIG. 9*d*, after the expiration of the five minute time interval, pressure begins to increase rapidly, going from 1,000 p.s.i. to 1,500 p.s.i., until the hydraulic disconnect is actuated at time T4. This elevation in pressure is indicated by a rise in amperage to 0.8 amperes. Thereafter, as shown in FIG. 9*e*, the amperage backs down to approximately 0.2 amperes.

While the invention has been shown in only one of its forms, it is not thus limited but is susceptible to various changes and modifications without departing from the spirit thereof.

What is claimed is:

1. A pressurization-extending device adapted for coupling in fluid communication with a source of pressurized fluid and a fluid-actuated wellbore tool, comprising:

input means for receiving a pressurized fluid from said source of pressurized fluid;

output means for directing said pressurized fluid to said fluid-actuated wellbore tool to supply an actuating force to said fluid-actuated wellbore tool; and timer means, responsive to said actuating force of said pressurized fluid, for automatically maintaining said actuating force of said pressurized fluid within said fluid-actuated wellbore tool at a preselected force level for a preselected time interval.

2. A pressurization-extending device according to claim 1, wherein said timer means include a fluid cavity which communicates with said input means through a bypass channel, and which is adapted in volume to receive a predetermined amount of fluid over said preselected time interval.

3. A pressurization-extending device according to claim 1, wherein said timer means includes at least one moveable piece and at least one stationary piece, and wherein said at least one moveable piece is advanced relative to said at least one stationary piece by said pressurized fluid from an initial condition to a final condition, and wherein passage of said at least one moveable piece from said initial condition to said final condition defines said preselected time interval of said timer means.

4. A pressurization-extending device according to claim 1, wherein said timer means comprises:

a cavity having first and second ends which at least in-part define a preselected volume;

a bypass channel for communicating said pressurized fluid to said first end of said cavity;

a piston member movable within said cavity and disposed at said first end during an initial operating mode, blocking passage of pressurized fluid from said bypass channel into said chamber;

means for biasing said piston member toward said first end until a preselected pressure level is obtained in said pressurized fluid;

wherein said timer means is operable in a plurality of operating modes, including:

an initial operating mode, wherein said piston member is urged into an initial position at said first end, by said means for biasing;

a start-up operating mode, wherein said means for biasing is at least in-part overridden;

a timing operating mode, wherein said piston member is moved between said first and second ends of said cavity in the duration of said preselected time interval while at least a portion of said pressurized fluid is diverted to said cavity; and a termination operating mode, wherein said piston member is disposed at said second end of said cavity, said pressurized fluid is no longer diverted to said cavity and is instead directed to said fluid-actuated wellbore tool through said output means.

5. A pressurization-extending device adapted for coupling in fluid communication with a source of pressurized fluid and a fluid-actuated wellbore tool, said fluid-actuated wellbore tool including an elastomeric element which is altered in shape between a running shape and a setting shape as pressurized fluid is directed into said fluid-actuated wellbore tool, comprising:

input means for receiving a pressurized fluid from said source of pressurized fluid;

output means for directing said pressurized fluid to said fluid-actuated wellbore tool to supply an actuating force to said fluid-actuated wellbore tool; and timer means, responsive to said actuating force of said pressurized fluid, for maintaining said actuating force of said pressurized fluid at a preselected force level for a preselected time interval of sufficient length to allow said elastomeric element of said fluid-actuated wellbore tool to be fully altered in shape between said running shape and said setting shape.

6. A pressurization-extending device according to claim 5, wherein said timer means provides a preselected time interval in which said preselected force is applied to said fluid-actuated tool to allow squaring-off of said fluid-actuated tool.

7. A pressurization-extending device according to claim 5, wherein said elastomeric element of said fluid-actuated wellbore tool comprises an annular elastomeric sleeve, and wherein said timer means provides a preselected time interval in which said preselected force is applied to said fluid-actuated wellbore tool to urge said annular elastomeric sleeve from a deflated running position to a fully inflated setting position.

8. A pressurization-extending device according to claim 5, wherein said timer means includes a fluid cavity which communicates with said input means through a bypass channel, and which is adapted in volume to receive a predetermined amount of fluid over said preselected time interval.

9. A pressurization-extending device according to claim 5, wherein said timer means includes at least one moveable piece and at least one stationary piece, and wherein said at least one moveable piece is advanced relative to said at least one stationary piece by said pressurized fluid condition to a final condition, and wherein passage of said at least one moveable piece from said initial condition to said final condition defines said preselected time interval of said timer means.

10. A pressurization-extending device according to claim 5, wherein said timer means comprises:

a cavity having first and second ends and defining a preselected volume;

a bypass channel for communicating said pressurized fluid to said first end of said cavity;

a piston member movable within said cavity and disposed at said first end during an initial operating mode, blocking passage of pressurized fluid from said bypass channel into said cavity;

means for biasing said piston member toward said first end until a preselected pressure level is obtained in said pressurized fluid;

wherein said timer means is operable in a plurality of operating modes, including:

an initial operating mode, wherein said piston member is urged into an initial position at said first end;

a start-up operating mode, wherein said means for biasing is at least in-part overridden;

a timing operating mode, wherein said piston member is moved between said first and second ends of said cavity in the duration of said preselected time interval while at least a portion of said pressurized fluid is diverted to said cavity; and a termination operating mode, wherein said piston member is disposed at said second end of said cavity, said pressurized fluid is no longer diverted to said cavity and is instead directed to said fluid-actuated wellbore tool through said output means.

11. A pressurization-extending device adapted for use in a wellbore when coupled in fluid communication with a source of pressurized fluid and a fluid-actuated wellbore tool, comprising:

input means for receiving a pressurized fluid from said source of pressurized fluid;

output means for directing said pressurized fluid to said fluid-actuated wellbore tool to supply an actuating force to said fluid-actuated wellbore tool;

timer means, responsive to said actuating force of said pressurized fluid, for automatically maintaining said actuating force of said pressurized fluid within said fluid-actuated wellbore tool at a preselected force level for a preselected time interval; and monitoring means for providing an indication of operation of said timer means.

12. A pressurization extending device according to claim 11, wherein said monitoring means comprises a visual indicator which provides a signal corresponding to operation of said source of pressurized fluid.

13. A pressurization extending device according to claim 11, wherein said monitoring means comprises a visual indicator which provides a signal corresponding in amplitude and duration with said actuating force of said pressurized fluid within said fluid-actuated wellbore tool.

14. A pressurization extending device according to claim 11, wherein said source of pressurized fluid comprises a pump disposed in said wellbore, and wherein said monitoring means comprises a means for monitoring power supplied to said pump.

15. A pressurization extending device according to claim 11:

wherein said source of pressurized fluid comprises a pump disposed in said wellbore;

wherein said fluid-actuated wellbore tool comprises an inflatable packing device with an elastomeric element which is urged between a deflated running position and an inflated setting position in engagement with said wellbore in response to pressurized fluid;

wherein said monitoring means comprises a means for monitoring power supplied to said pump; and wherein said timer means is operable in a plurality of operating modes, including:

an initial operating mode, wherein pressurized fluid is directed between from said input means to said output means to inflate said inflatable packing device, and wherein said monitoring means provides a signal corresponding to gradually increasing fluid pressure within said inflatable packing device;

a start-up operating mode, wherein said timer means is initiated in response to said pressurized fluid within said inflatable packing device obtaining a preselected start-up pressure;

a timing operating mode, wherein said timer means automatically maintains said actuating force of said fluid-actuating wellbore tool at a preselected force level for a preselected time interval, wherein at least a portion of said pressurized fluid is diverted from between said input means and said output means, and wherein said monitoring means provides a signal indicative of constant pressure within said inflatable packing device;

a termination operating mode, wherein said preselected time interval expires, said pressurized fluid is no longer diverted from between said input means and said output means, said preselected force level is no longer maintained, and said monitoring means no longer provides a signal indicative of constant pressure within said inflatable packing device.

16. A pressurization-extending device adapted for coupling in fluid communication with a source of pressurized fluid and a fluid-actuated wellbore tool, comprising:

input means for receiving a pressurized fluid from said source of pressurized fluid;

output means for directing said pressurized fluid to said fluid-actuated wellbore tool to supply an actuating force to said fluid-actuated wellbore tool; and switching means for selectively diverting, at a preselected pressure threshold, pressurized fluid received at said input means and temporarily diminishing exhaust of said pressurized fluid from said output means; and timer means, responsive to said switching means, for automatically maintaining said actuating force of said pressurized fluid at a preselected force level for a preselected time interval.

17. A pressurization-extending device according to claim 16, wherein switching means includes at least one pressure sensitive valve member.

18. A pressurization-extending device according to claim 16, wherein said timer means maintains said actuating force of said pressurized fluid at a preselected force level by temporarily diverting said pressurized fluid from between said input means and said output means.

19. A pressurization-extending device according to claim 16, wherein said switching means remains in a normally-closed condition until a preselected pressure threshold is obtained in said pressurized fluid.

20. A method of actuating a fluid-actuated wellbore tool, comprising:

providing a source of pressurized fluid;

providing a pressurization-extending device;

coupling together said source of pressurized fluid, said pressurization-extending device, and said fluid-actuated wellbore tool;

directing pressurized fluid to said fluid-actuated wellbore tool until a preselected pressure threshold is obtained in said pressurized fluid; then, initiating operation of said pressurization extending device;

automatically maintaining, with said pressurization-extending device, said pressurized fluid within said fluid-actuated wellbore tool at a preselected pressure level for a preselected time interval; and terminating operation of said pressurization-extending device upon expiration of said preselected time interval.

21. A method of actuating a fluid-actuated wellbore tool according to claim 20, further comprising:

providing a signal indicative of said termination of operation of said pressurization-extending device.

22. A method of actuating a fluid-actuated wellbore tool according to claim 20, wherein said pressurization-extending device includes an input means for receiving pressurized wellbore fluid from said source of pressurized fluid and an output means for directing pressurized fluid to said fluid-actuated wellbore fluid, wherein during operation of said pressurization-extending device at least a portion of said pressurized fluid is diverted from said output means.

23. A method of actuating a fluid-actuated wellbore tool according to claim 20, wherein said fluid-actuated wellbore tool includes an elastomeric element operable in a deflated running position and an inflated setting position, and wherein said pressurization-extending device maintains said pressurized fluid at a preselected pressure level for a preselected time interval sufficiently long in duration to fully inflate said elastomeric element to an inflated setting position.

24. A method of actuating a fluid-actuated wellbore tool according to claim 20, further comprising:

providing a signal indicative of initiation, duration, and termination of operation of said pressurization-extending device.

25. A method of actuating a fluid-actuated wellbore tool according to claim 20, wherein said source of pressurized fluid, said pressurization-extending device, and said fluid-actuated wellbore tool are coupled together in a string; and wherein said method further includes:

providing a hydraulically-actuated releasing device between said source of pressurized fluid and said fluid-actuated wellbore tool; and actuating said hydraulically-actuated releasing device to separate said source of pressurized fluid from said fluid-actuated wellbore tool.

26. A pressurization-extending device according to claim 1, wherein said timer means comprises:

a piston member disposed in a first condition during an initial operating mode, blocking passage of pressurized fluid from said bypass channel to said fluid-actuated wellbore tool;

means for biasing said piston member toward said first condition until a preselected pressure level is obtained in said pressurized fluid;

wherein said timer means is operable in a plurality of operating modes, including:

an initial operating mode, wherein said piston member is urged into said first condition, by said means for biasing;

a start-up operating mode, wherein said means for biasing is at least in-part overridden;

a timing operating mode, wherein said piston member is moved between said first condition and a second condition in the duration of said preselected time interval while at least a portion of said pressurized fluid is diverted; and a termination operating mode, wherein said piston member is disposed in said second condition, said pressurized fluid is no longer diverted and is instead directed to said fluid-actuated wellbore tool through said output means.

27. A pressurization-extending device according to claim 5, wherein said timer means comprises:

a piston member disposed in a first condition during an initial operating mode, blocking passage of pressurized fluid from said bypass channel to said fluid-actuated wellbore tool;

means for biasing said piston member toward said first end until a preselected pressure level is obtained in said pressurized fluid;

wherein said timer means is operable in a plurality of operating modes, including:

an initial operating mode, wherein said piston member is urged into said first condition;

a start-up operating mode, wherein said means for biasing is at least in-part overridden;

a timing operating mode, wherein said piston member is moved between said first condition and a second condition in the duration of said preselected time interval while at least a portion of said pressurized fluid is diverted; and a termination operating mode, wherein said piston member is disposed in said second condition, said pressurized fluid is no longer diverted and is instead directed to said fluid-actuated wellbore tool through said output means.

* * * * *